US012410920B2

(12) United States Patent
Ni et al.

(10) Patent No.: US 12,410,920 B2
(45) Date of Patent: Sep. 9, 2025

(54) HYBRID HEAT SYSTEM, THE CAPACITY ALLOCATION CONTROL METHOD THEREOF, READABLE STORAGE MEDIUM AND CONTROL SYSTEM

(71) Applicant: Carrier Corporation, Palm Beach Gardens, FL (US)

(72) Inventors: Jian Ni, Shanghai (CN); Jingkai Weng, Shanghai (CN); Tao Peng, Shanghai (CN); Xiaoru Li, Shanghai (CN); Hui Yang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 252 days.

(21) Appl. No.: 18/178,663

(22) Filed: Mar. 6, 2023

(65) Prior Publication Data

US 2023/0288076 A1 Sep. 14, 2023

(30) Foreign Application Priority Data

Mar. 9, 2022 (CN) ..... 202210234677.6

(51) Int. Cl.
*F24D 19/10* (2006.01)

(52) U.S. Cl.
CPC ..... *F24D 19/1081* (2013.01); *F24D 19/1072* (2013.01); *F24D 2200/123* (2013.01)

(58) Field of Classification Search
CPC ..... F24D 19/1081; F24D 19/1072; F24D 19/106; F24D 2200/123; F24F 11/46; F24F 11/62; F24F 11/64; F24F 11/86
See application file for complete search history.

(56) References Cited

U.S. PATENT DOCUMENTS 7,661,274 B2 2/2010 Crane et al.
8,646,284 B2 2/2014 Ueda
9,285,128 B2 3/2016 Takata et al.
(Continued)

FOREIGN PATENT DOCUMENTS

CN 101865565 B 9/2011
CN 108105964 B 12/2019
(Continued)

OTHER PUBLICATIONS

European Search Report for Application No. 23160981.9, Issued Jul. 21, 2023, 9 Pages.

*Primary Examiner* — Marc E Norman
(74) *Attorney, Agent, or Firm* — CANTOR COLBURN LLP

(57) ABSTRACT

A hybrid heat system, a capacity allocation control method thereof, a readable storage medium and a control system. The hybrid heat system includes a plurality of modular heat recovery units with an air-conditioning mode and a water-heating mode, and a plurality of modular air-conditioning units with an air-conditioning mode, the capacity allocation control method including: a classification step S100 for classifying the compressors in the plurality of modular heat recovery units and the plurality of modular air-conditioning units according to unit category, unit state and start-stop state; a sorting step S200 for sorting classified compressors according to operating time; and a search step S300 for searching target compressors from sorted compressors based on preset energy efficiency search criteria.

23 Claims, 3 Drawing Sheets

(56) References Cited

U.S. PATENT DOCUMENTS

| | | | | |
|---|---|---|---|---|
| 9,429,345 | B2 | 8/2016 | Kopko et al. | |
| 9,494,953 | B2 | 11/2016 | Morrow et al. | |
| 9,816,739 | B2 | 11/2017 | Tambovtsev et al. | |
| 9,869,466 | B2 | 1/2018 | Thomson | |
| 9,915,450 | B2 | 3/2018 | Seggerman | |
| 9,951,962 | B2 * | 4/2018 | Tamaki | F24H 15/385 |
| 10,401,068 | B2 | 9/2019 | Kopko et al. | |
| 10,928,107 | B2 | 2/2021 | Schmidt et al. | |
| 11,060,767 | B2 | 7/2021 | Fredslund et al. | |
| 11,162,723 | B2 | 11/2021 | Wang et al. | |
| 11,175,076 | B2 | 11/2021 | Kopko et al. | |
| 2009/0120110 | A1 | 5/2009 | Grabon et al. | |
| 2013/0220589 | A1 | 8/2013 | Liu | |
| 2016/0033166 | A1 * | 2/2016 | Hebert | F25B 30/02 62/79 |
| 2020/0158390 | A1 | 5/2020 | Shen et al. | |
| 2022/0003429 | A1 * | 1/2022 | Rosén | F24F 11/62 |
| 2022/0076852 | A1 * | 3/2022 | Przybylski | H04L 41/00 |

FOREIGN PATENT DOCUMENTS

| | | | |
|---|---|---|---|
| CN | 111033155 | A | 4/2020 |
| CN | 111928430 | A | 11/2020 |
| EP | 3047218 | B1 | 4/2021 |

* cited by examiner

HYBRID HEAT SYSTEM, THE CAPACITY ALLOCATION CONTROL METHOD THEREOF, READABLE STORAGE MEDIUM AND CONTROL SYSTEM

FOREIGN PRIORITY

This application claims priority to Chinese Patent Application No. 202210234677.6, filed Mar. 9, 2022, and all the benefits accruing therefrom under 35 U.S.C. § 119, the contents of which in its entirety are herein incorporated by reference.

FIELD OF THE INVENTION

The present application relates to the field of hybrid heat systems, and in particular to a capacity allocation control method for a hybrid heat system.

BACKGROUND OF THE INVENTION

As highly mature devices, air conditioning systems and heat recovery systems are widely used in commercial buildings, household space, cold chain transportation and other scenarios, which provide relatively comfortable cooling/heating/water heating effects. During application, with additional demands or iteration of products, it is usually necessary to add units with cooling/heating/water heating functions. At this point, the modular unit has a better application range based on its easier addition and deletion characteristics. For example, modular air conditioning units may be further added when the system currently in use requires additional cooling/heating functions or additional power for cooling/heating. For another example, modular heat recovery units can be further added when the system currently in use requires additional cooling/heating/water heating functions or additional power for cooling/heating/water heating. For such a hybrid heat system with multiple modular units and with the possibility of adding or deleting modular units, how to optimize the allocation control of compressor capacity becomes an urgent problem to be solved.

SUMMARY OF THE INVENTION

The present application provides a hybrid heat system, a capacity allocation control method thereof, a readable storage medium, and a control system, so as to at least partially solve or alleviate the problems in the prior art.

According to one aspect of the present application, a capacity allocation control method for a hybrid heat system is provided, wherein the hybrid heat system comprises a plurality of modular heat recovery units with an air-conditioning mode and a water-heating mode, and a plurality of modular air-conditioning units with an air-conditioning mode, wherein the control method comprises: a classification step S100 for classifying the compressors in the plurality of modular heat recovery units and the plurality of modular air-conditioning units according to unit category, unit state and start-stop state; a sorting step S200 for sorting the classified compressors according to operating time; a search step S300 for searching the target compressors from the sorted compressors based on preset energy efficiency search criteria.

In addition to one or more of the above features, or as an alternative, in another embodiment, the classification in the classification step S100 includes one or more groups in the following categories: First Group: classifying compressors in all the plurality of modular heat recovery units and the plurality of modular air-conditioning units which operate normally in the air-conditioning mode according to start-stop state; Second Group: classifying compressors in all the plurality of modular air-conditioning units which operate normally in the air-conditioning mode according to start-stop state; Third Group: classifying compressors in all the plurality of modular heat recovery units which operate normally in the air-conditioning mode according to start-stop state; Fourth Group: classifying compressors in all the plurality of modular heat recovery units which operate normally in the water-heating mode according to start-stop state; Fifth Group: classifying compressors in all the plurality of modular heat recovery units which operate normally in both the air-conditioning mode and the water-heating mode according to start-stop state.

In addition to one or more of the above features, or as an alternative, in another embodiment, the start-stop state includes: compressor start, compressor start for over a first preset time, compressor stop and compressor stop for over a second preset time.

In addition to one or more of the above features, or as an alternative, in another embodiment, the sorting step S200 also includes: sorting the classified compressors in a start state in descending order according to historical operating time; and sorting the classified compressors in a stop state in ascending order according to historical operating time.

In addition to one or more of the above features, or as an alternative, in another embodiment, the energy efficiency search criteria in the search step S300 include one or more of the following: classification group, unit category, compressor capacity in the unit, compressor capacity of a first circuit in the unit, compressor capacity of a second circuit in the unit, and compressor operating mode.

In addition to one or more of the above features, or as an alternative, in another embodiment, when the hybrid heat system is operating in a cooling or heating mode: if the system has a capacity loading requirement, one or more of the target compressors in the First Group that have stopped for over a second preset time and are sorted in ascending order according to historical operating time are searched; or, if the system has a capacity unloading requirement, one or more of the target compressors in the First Group that have started for over a first preset time and are sorted in descending order according to historical operating time are searched.

In addition to one or more of the above features, or as an alternative, in another embodiment, if the system has a capacity loading requirement, one or more of the target compressors are searched according to the priorities of: the compressor capacity in the unit being 0%, the compressor capacity of the first circuit in the unit being 0%, and without additional restrictions; or, if the system has a capacity unloading requirement, one or more of the target compressors are searched according to the priorities of: the compressor capacity of the first circuit in the unit being 100%, the compressor capacity of the second circuit in the unit being greater than 0%, and without additional restrictions.

In addition to one or more of the above features, or as an alternative, in another embodiment, when the hybrid heat system is operating in the water-heating mode: if the system has a capacity loading requirement, one or more of the target compressors in the Fourth Group that have stopped for over a second preset time and are sorted in ascending order according to historical operating time are searched; or, if the system has a capacity unloading requirement, one or more of the target compressors in the Fourth Group that have started for over a first preset time and are sorted in descending order according to historical operating time are searched.

In addition to one or more of the above features, or as an alternative, in another embodiment, when the hybrid heat system is operating in the heating and water heating mode: if the air-conditioning mode of the system has a capacity loading requirement, search is performed in turn according to the following priorities: one or more of the target compressors in the Second Group that have stopped for over a second preset time and are sorted in ascending order according to historical operating time; one or more of the target compressors in the Third Group that have stopped for over a second preset time and are sorted in ascending order according to historical operating time; and one or more of the target compressors in the Third Group that have started for over a first preset time and are in the water heating mode and sorted in descending order according to historical operating time; or, if the air-conditioning mode of the system has a capacity unloading requirement, search is performed in turn according to the following priorities: one or more of the target compressors in the Third Group that have started for over a first preset time and are sorted in descending order according to historical operating time; and one or more of the target compressors in the Second Group that have started for over a first preset time and are sorted in descending order according to historical operating time; or, if the water-heating mode of the system has a capacity loading requirement, search is performed in turn according to the following priorities: one or more of the target compressors in the Fourth Group that have stopped for over a second preset time and are sorted in ascending order according to historical operating time; and one or more of the target compressors in the Fourth Group that have started for over a first preset time and are in the heating mode and sorted in descending order according to historical operating time; or, if the water-heating mode of the system has a capacity unloading requirement, one or more of the target compressors in the Fourth Group that have started for over a first preset time and are in the water-heating mode and sorted in descending order according to historical operating time are searched.

In addition to one or more of the above features, or as an alternative, in another embodiment, if the air-conditioning mode of the system has a capacity loading requirement, for the one or more of the target compressors in the Second Group, one or more of the target compressors are searched according to the priorities of the compressor capacity in the unit being 0%, the compressor capacity of the first circuit in the unit being 0%, and without additional restrictions.

In addition to one or more of the above features, or as an alternative, in another embodiment, if the air-conditioning mode of the system has a capacity unloading requirement, for one or more of the target compressors in the Third Group, one or more of the target compressors are searched according to the priorities of: the compressor capacity in the unit being 0% and operating normally in the water-heating mode, and the compressor capacity in the unit being 0% and without additional restrictions; or, if the air-conditioning mode of the system has a capacity unloading requirement, for the one or more of the target compressors in the Second Group, one or more of the target compressors are searched according to the priorities of the compressor capacity of the first circuit in the unit being 0%, and the compressor capacity of the second circuit in the unit being greater than 0%.

In addition to one or more of the above features, or as an alternative, in another embodiment, if the water-heating mode of the system has a capacity loading requirement, for one or more of the target compressors in the Fourth Group, one or more of the target compressors are searched according to the priorities of the compressor in the unit operating abnormally in the air-conditioning mode and without additional restrictions.

In addition to one or more of the above features, or as an alternative, in another embodiment, if the water-heating mode of the system has a capacity unloading requirement, for one or more of the target compressors in the Fourth Group, one or more of the target compressors are searched according to the priorities of the compressor in the unit operating normally in the air-conditioning mode and without additional restrictions.

In addition to one or more of the above features, or as an alternative, in another embodiment, when the hybrid heat system is operating in the cooling and water heating mode: if both the air-conditioning mode and the water-heating mode of the system have a capacity loading requirement, one or more of the target compressors in the Fifth Group that have stopped for over a second preset time and are sorted in ascending order according to historical operating time are searched; or, if both the air-conditioning mode and the water-heating mode of the system have a capacity unloading requirement, one or more of the target compressors in the Fifth Group that have started for over a first preset time, and are in the cooling and water-heating mode and sorted in descending order according to historical operating time are searched; or, if the air-conditioning mode of the system has a capacity unloading requirement, search is performed in turn according to the following priorities: one or more of the target compressors in the Third Group that have started for over a first preset time, and are in the cooling mode and sorted in descending order according to historical operating time; one or more of the target compressors in the Second Group that have started for over a first preset time, and are in the cooling mode and sorted in descending order according to historical operating time; and one or more of the target compressors in the Third Group that have started for over a first preset time, and are in the cooling and water-heating mode and sorted in descending order according to historical operating time; or, if the water-heating mode of the system has a capacity unloading requirement, search is performed in turn according to the following priorities: one or more of the target compressors in the Fourth Group that have started for over a first preset time, and are in the water-heating mode and sorted in descending order according to historical operating time; and one or more of the target compressors in the Fourth Group that have started for over a first preset time, and are in the cooling and water-heating mode and sorted in descending order according to historical operating time; or, if the air-conditioning mode of the system has a capacity loading requirement, search is performed in turn according to the following priorities: one or more of the target compressors in the Fourth Group that have started for over a first preset time, and are in the water-heating mode and sorted in descending order according to historical operating time; one or more of the target compressors in the Fourth Group that are started, in the water-heating mode and sorted in descending order according to historical operating time; one or more of the target compressors in the Second Group that have stopped for over a second preset time, and are sorted in ascending order according to historical operating time; and one or more of the target compressors in the Third Group that have stopped for over a second preset time, and are sorted in ascending order according to historical operating time; or, if the water-heating mode of the system has a capacity loading requirement, search is performed in turn according to the following priorities: one or more of the target compressors in the Third Group that have started for over a first preset time, and are in the cooling mode and sorted in descending order according to historical operating time; one or more of the target compressors in the Fourth Group that are started, in the cooling mode, and sorted in descending order according to historical operating time; and one or more of the target compressors in the Fourth group that have stopped for over a second preset time, and are sorted in ascending order according to historical operating time.

In addition to one or more of the above features, or as an alternative, in another embodiment, if the air-conditioning mode of the system has a capacity unloading requirement, for one or more of the target compressors in the Third Group, one or more of the target compressors are searched according to the priorities of the compressor in the unit operating normally in the water-heating mode and without additional restrictions; or, if the air-conditioning mode of the system has a capacity unloading requirement, for one or more of the target compressors in the Second Group, one or more of the target compressors are searched according to the priorities of the compressor capacity of the first circuit in the unit being 100%, the compressor capacity of the second circuit in the unit being greater than 0%, and without additional restrictions; or, if the air-conditioning mode of the system has a capacity unloading requirement, for one or more of the target compressors in the Third Group, one or more of the target compressors are searched according to the priorities of stopping the compressors in the Third Group and starting the compressors in the Fifth Group, and switching the compressors in the Third Group to the empty water-heating mode.

In addition to one or more of the above features, or as an alternative, in another embodiment, if the water-heating mode of the system has a capacity unloading requirement, for one or more of the target compressors in the Fourth Group, one or more of the target compressors are searched according to the priorities of the compressor in the unit operating normally in the air-conditioning mode, and without additional restrictions; or, if the water-heating mode of the system has a capacity unloading requirement, for one or more of the target compressors in the Fourth Group, one or more of the target compressors are searched according to the priorities of: stopping the compressor in the Fourth Group and starting the compressor with a compressor capacity of 0% in the Second Group, stopping the compressor in the Fourth Group and starting the compressor with the compressor capacity of the second circuit being 0% in the Second Group, stopping the compressor in the Fourth Group and starting the compressor in the Second Group, stopping the compressor in the Fourth Group and starting the compressor in the Fifth Group, and switching the compressor in the Fourth Group to the cooling mode.

In addition to one or more of the above features, or as an alternative, in another embodiment, if the air-conditioning mode of the system has a capacity loading requirement, for one or more of the target compressors in the Fourth Group, one or more of the target compressors are searched according to the priorities of: stopping the compressor in the Fourth Group that has started for over a first preset time and starting the stopped compressor in the Fifth Group, stopping the compressor in the Fourth Group and starting the stopped compressor in the Fifth Group, switching the compressor in the Fourth Group that has started for over a first preset time and operating normally in the air-conditioning mode to the cooling and water-heating mode; and one or more of the target compressors are searched according to the priorities of switching the compressor in the Fourth Group that operate normally in the air-conditioning mode to the cooling and water-heating mode; or, if the air-conditioning mode of the system has a capacity loading requirement, for one or more of the target compressors in the Second Group, one or more of the target compressors are searched according to the priorities of the compressor capacity in the unit being 0%, and the compressor capacity of the first circuit in the unit being 0%, and without additional restrictions; or, if the air-conditioning mode of the system has a capacity loading requirement, for one or more of the target compressors in the Third Group, one or more of the target compressors are searched according to the priorities of the compressor in the unit operating abnormally in the water-heating mode, and without additional restrictions.

In addition to one or more of the above features, or as an alternative, in another embodiment, if the water-heating mode of the system has a capacity loading requirement, for one or more of the target compressors in the Third Group, one or more of the target compressors are searched according to the priorities of stopping the compressor in the Third Group that has started for over a first preset time and starting the stopped compressor in the Fifth Group, stopping the compressor in the Third Group and starting the stopped compressor in the Fifth Group, switching the compressor in the Third Group that has started for over a first preset time and operate normally in the water-heating mode to the cooling and water-heating mode, and switching the compressor in the Third Group that has started and operate normally in the water-heating mode to the cooling and water-heating mode; or, if the water-heating mode of the system has a capacity loading requirement, for one or more of the target compressors in the Fourth Group, one or more of the target compressors are searched according to the priorities of the compressor in the unit operating normally in the air-conditioning mode, and without additional restrictions.

In addition to one or more of the above features, or as an alternative, in another embodiment, the capacity allocation control method also includes: a consolidation step S400 for consolidating a compressor in the cooling mode and a compressor in the water-heating mode into a compressor operating in the cooling and water-heating mode.

In addition to one or more of the above features, or as an alternative, in another embodiment, the consolidation priorities of the consolidated step S400 include: consolidating one or more of the target compressors in the First Group that have been started, are in the cooling mode and sorted in descending order according to historical operating time, and one or more of the target compressors in the Fourth Group that have been started, are in the water-heating mode and sorted in descending order according to historical operating time into operating one or more of the target compressors in the Fifth Group that have stopped and are sorted in ascending order according to historical operating time; consolidating one or more of the target compressors in the First Group that have started, are in the cooling mode and sorted in descending order according to historical operating time, and one or more of the target compressors in the Fourth Group that have started, are in the water-heating mode and sorted in descending order according to historical operating time into operating one or more of the target compressors in the Third Group that have started, and operate normally in the air-conditioning mode and sorted in descending order according to historical operating time; and consolidating one or more of the target compressors in the First Group that have started, are in the cooling mode and sorted in descending order according to historical operating time, and one or more of the target compressors in the Fourth Group that have started, are in the water-heating mode and sorted in descending order according to historical operating time into operating one or more of the target compressors in the Fourth Group that have started, and operate normally in the water-heating mode and sorted in descending order according to historical operating time.

To achieve at least one object of the present application, according to another aspect of the present application, a readable storage medium is also provided, which is used for storing the capacity allocation control method for a hybrid heat system as described above.

To achieve at least one object of the present application, according to yet another aspect of the present application, a control system is further provided, which comprises: the readable storage medium as described above; and a processor for performing the capacity allocation control method stored on the readable storage medium.

To achieve at least one object of the present application, according to still another aspect of the present application, a hybrid heat system is further provided, which comprises: a plurality of modular heat recovery units capable of operating the air-conditioning mode and the water-heating mode respectively; a plurality of modular air-conditioning units capable of operating the air-conditioning mode; and a controller for performing the capacity allocation control method for a hybrid heat system as described above.

The capacity allocation control method for a hybrid heat system according to the present application, by classifying, sorting and searching the respective compressors involved in the modular heat recovery units and the modular air-conditioning units in the hybrid heat system, makes it possible to find target compressors that satisfy customers' operating requirements and the purpose of energy efficiency optimization, and to achieve the effect of balancing the operating time of each compressor and improving the overall reliability of the system. The hybrid heat system, the readable storage medium and the control system according to the present application are closely related to the aforementioned capacity allocation control method and therefore have the corresponding technical effects.

Figure 1:
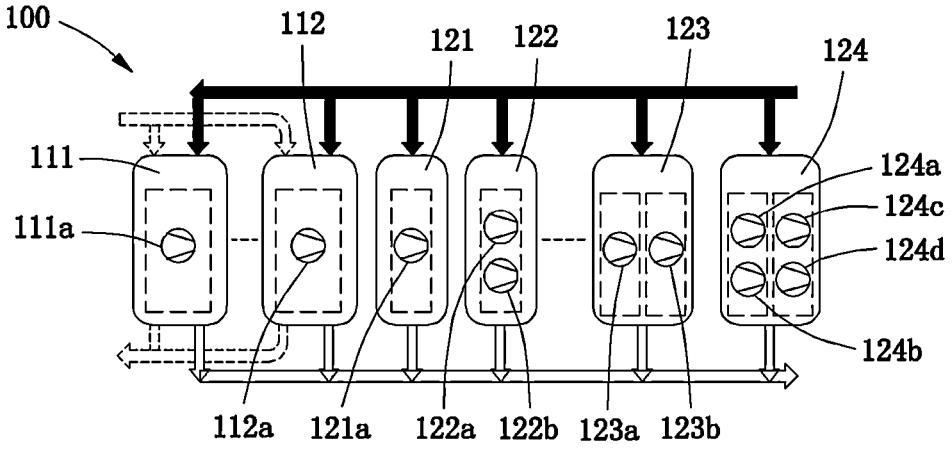
FIG. 1 is a schematic diagram of system operation of an embodiment of a hybrid heat system in the cooling mode.

| Reference numerals | |
|---|---|
| 100 | hybrid heat system |
| 111, 112 | modular heat recovery unit |
| 111a, 112a | compressor |

-continued

| Reference numerals | |
|---|---|
| 121, 122, 123, 124 | modular air-conditioning unit |
| 121a, 122a, 122b, 123a, 123b, 124a, 124b, 124c, 124d | compressor |

DETAILED DESCRIPTION OF THE EMBODIMENT(S) OF THE INVENTION

The present application will be described in detail hereinafter with reference to the exemplary embodiments shown in the accompanying drawings. However, it should be understood that the present application can be implemented in many different forms, and should not be construed as being limited to the embodiments set forth herein. These embodiments are provided here for the purpose of making the disclosure of the present application more complete and comprehensive, and fully conveying the concept of the present application to those skilled in the art.

With reference to FIGS. 1 to 5, the operating states of an embodiment of a hybrid heat system in different operating modes are shown. In general, the hybrid heat system comprises: a plurality of modular heat recovery units 111, 112 and a plurality of modular air-conditioning units 121, 122, 123, 124. Wherein, the main difference between the two is that each of the modular heat recovery units 111 and 112 can run both the air-conditioning mode (i.e., cooling mode and heating mode) and the water-heating mode, while each of the modular air-conditioning units 121, 122, 123 and 124 can only run the air-conditioning mode. For illustrative purposes, the concept of the present invention is described using two modular heat recovery units 111, 112 and four modular air-conditioning units 121, 122, 123, 124 with different circuit compressor layouts. However, according to the concept of the present invention, the hybrid heat system can be applied to build a network between any number of modular heat recovery units and any number of modular air-conditioning units.

The flow path of the heat-carrying medium (e.g., water) passing through the respective units is schematically shown in the figures, while the corresponding refrigerant flow path is omitted. However, those skilled in the art understand the layout scheme of a conventional refrigerant flow path, which can be applied to the concept of the present invention when it is not in explicit conflict with the concept.

It should be noted that both the modular heat recovery units 111, 112 and the plurality of modular air-conditioning units 121, 122, 123, 124 have various possible layout schemes for refrigerant flow path. Considering that the compressor is the main analysis object for capacity allocation in this concept, several possible compressor layout schemes are described herein only for illustrative purposes. An example is given below in conjunction with FIG. 1.

For example, the modular heat recovery units 111, 112 in FIG. 1 each include a refrigerant circuit having only one compressor 111*a*, 112*a*, respectively. The modular air-conditioning unit 121 includes a refrigerant circuit having only one compressor 121*a*. The modular-air conditioning unit 122 includes a single refrigerant circuit having two compressors 122*a* and 122*b* at the same time. The modular air-conditioning unit 123 includes two refrigerant circuits each having one compressor 123*a*, 123*b*. The modular air-conditioning unit 124 includes two refrigerant circuits each having two compressors 124*a*, 124*b*, and 124*c*, 124*d*. In the figure, the refrigerant circuits are shown with dotted line frames.

With continued reference to FIGS. 1 to 5, five operating modes of the aforementioned hybrid heat system are shown. In the figures, the solid black arrows denote the flow direction of hot water, the hollow black arrows denote the flow direction of cold water, and the hollow dotted line arrows denote disconnected pipelines.

As shown in FIG. 1, in the cooling mode, the plurality of modular heat recovery units 111, 112 and the plurality of modular air-conditioning units 121, 122, 123, 124 can all participate in operation. At this time, hot water flows through each unit via the air-conditioning circuit and exchanges heat with the refrigerant circuit in each unit, flows out after being cooled, and is then transported to each space to be cooled via the air-conditioning circuit to achieve cooling. After completion of cooling, the hot water returns to each unit and starts a new cycle.

Figure 2:
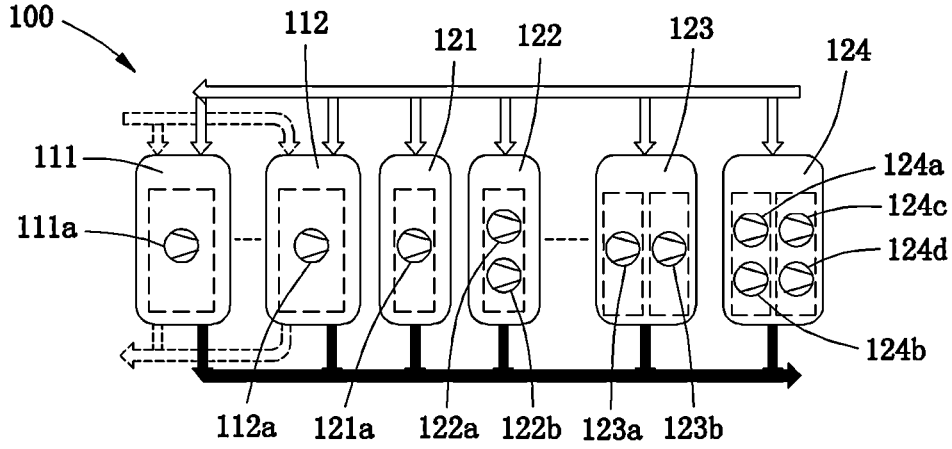
FIG. 2 is a schematic diagram of system operation of an embodiment of a hybrid heat system in the heating mode.

As shown in FIG. 2, in the heating mode, the plurality of modular heat recovery units 111, 112 and the plurality of modular air-conditioning units 121, 122, 123, 124 can all participate in operation. At this time, cold water flows through each unit via the air-conditioning circuit and exchanges heat with the refrigerant circuit in each unit, flows out after being heated, and is then transported to each space to be heated via the air-conditioning circuit to achieve heating. After completion of heating, the cold water returns to each unit and starts a new cycle.

Figure 3:
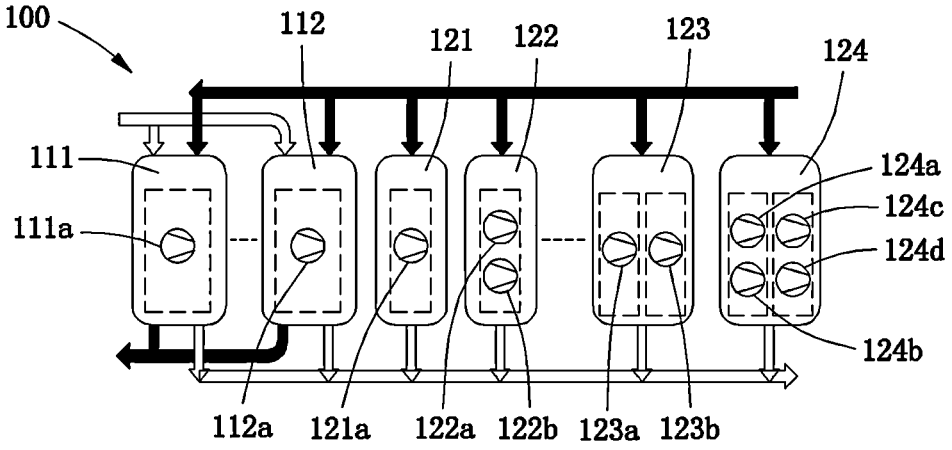
FIG. 3 is a schematic diagram of system operation of an embodiment of a hybrid heat system in the cooling and water-heating mode.

As shown in FIG. 3, in the cooling and water-heating mode, the plurality of modular heat recovery units 111, 112 and the plurality of modular air-conditioning units 121, 122, 123, 124 can all participate in operation. At this time, on the one hand, hot water flows through each unit via the air-conditioning circuit and exchanges heat with the refrigerant circuit in each unit, flows out after being cooled, and is then transported to each space to be cooled via the air-conditioning circuit to achieve cooling, where the hot water, upon completion of cooling, returns to each unit and starts a new cycle; on the other hand, cold water flows through each of the modular heat recovery units 111, 112 via the water-heating circuit and exchanges heat with the refrigerant circuit in each unit, flows out after being heated, and is then transported to each location that requires water via the water-heating circuit.

Figure 4:
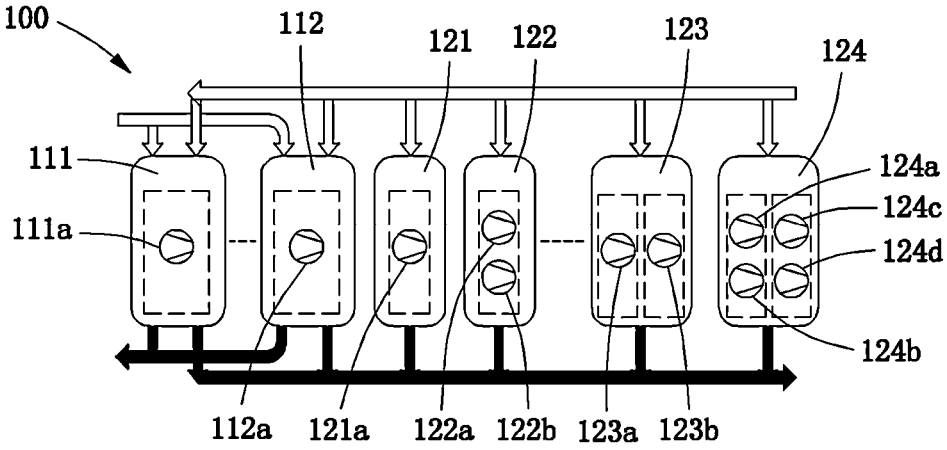
FIG. 4 is a schematic diagram of system operation of an embodiment of a hybrid heat system in the heating and water-heating mode.

As shown in FIG. 4, in the heating and water-heating mode, the plurality of modular heat recovery units 111, 112 and the plurality of modular air-conditioning units 121, 122, 123, 124 can all participate in operation. At this time, on the one hand, cold water flows through each unit via the air-conditioning circuit and exchanges heat with the refrigerant circuit in each unit, flows out after being heated, and is then transported to each space to be heated via the air-conditioning circuit to achieve heating, where the cold water, upon completion of heating, returns to each unit and starts a new cycle; on the other hand, cold water flows through each of the modular heat recovery units 111, 112 via the water-heating circuit and exchanges heat with the refrigerant circuit in each unit, flows out after being heated, and is then transported to each location that requires water via the water-heating circuit.

Figure 5:
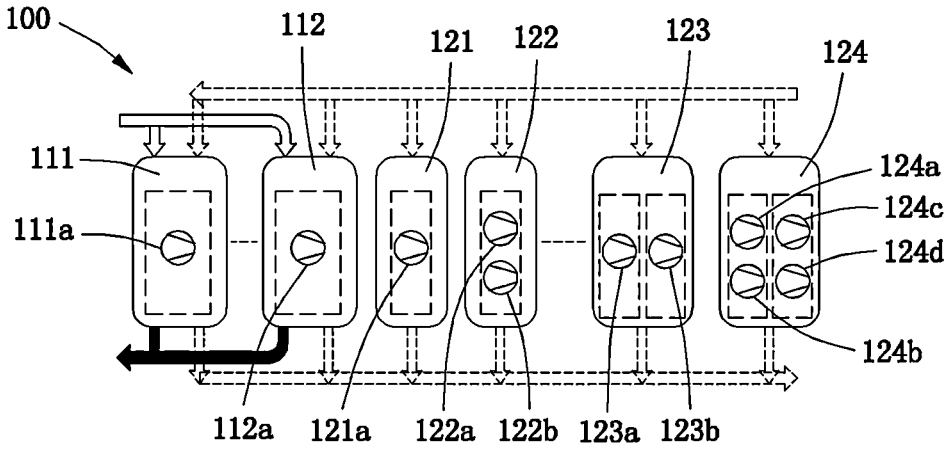
FIG. 5 is a schematic diagram of system operation of an embodiment of a hybrid heat system in the water-heating mode.

As shown in FIG. 5, in the water-heating mode, the plurality of modular heat recovery units 111, 112 can both participate in operation. At this time, cold water flows through each of the modular heat recovery units 111, 112 via the water-heating circuit and exchanges heat with the refrigerant circuit in each unit, flows out after being heated, and is then transported to each location that requires water via the water-heating circuit.

Regarding the various operating modes of the aforementioned hybrid heat system, the source of the cooling/heating/water heating capacity is the compressors in each unit, and the operating states of these compressors are affected by many factors. For example, due to different operating modes that can be executed, the compressors in the modular heat recovery units 111 and 112 may face more operating scenarios than the compressors in the modular air-conditioning units 121, 122, 123, 124. For another example, since the respective units are added to the system at different time, compressors in earlier configured units may face more operating scenarios than the compressors in later configured units. For yet another example, compressors in the units that have been operating normally all the time may face more operating scenarios than compressors in the units that are lack of operating due to malfunctions and other accidents. Such factors will affect the operating states of the compressors, and then their respective service life and overall reliability of the system. Therefore, the concept of the present invention proposes a capacity allocation control method for such hybrid heat systems, which can be implemented by configuring corresponding controllers in the hybrid heat systems.

In summary, the capacity allocation control method for a hybrid thermal system includes a classification step S100, a sorting step S200 and a search step S300.

Wherein, in the classification step S100, the compressors 111*a*, 112*a*, 121*a*, 122*a*, 122*b*, 123*a*, 123*b*, 124*a*, 124*b*, 124*c*, 124*d* in the plurality of modular heat recovery units 111, 112 and the plurality of modular air-conditioning units 121, 122, 123, 124 can be classified according to unit category, unit state and start-stop state. Wherein, the unit category means that the basis for classification is whether the unit belongs to the modular heat recovery unit or the modular air-conditioning unit; unit state means whether the unit operates normally in air-conditioning mode, operates normally in water-heating mode, or operates normally in total heat recovery mode; and start-stop state means that the basis for classification is whether the compressor in the unit is in start state or stop state. It should be understood that the classification for unit states does not mean it is compulsory that the unit is in the current mode, but aims to express that the unit is capable of operating normally in the relevant mode, i.e. all the hardware and software used to run the relevant mode are in the normal operating state and are not in the maintenance or failure state. The classification step S100 provides a solid basis for subsequent searches for the appropriate target compressor to execute the start-stop commands, where proper classification helps to facilitate an efficient and accurate search process thereafter.

In the sorting step S200, the classified compressors can be sorted according to their operating time, so that the target compressors with too long or too short operating time can be first screened out during the search process, thus achieving system balance among compressors of all units, optimizing efficiency and improving system reliability.

In the search step S300, the target compressors can be searched from the sorted compressors based on preset energy efficiency search criteria. This step is performed to search for the most suitable or the second most suitable compressor from the classified and sorted compressors in the respective units, and enable it to execute loading, hold or unloading instructions from customers for different operating modes.

The capacity allocation control method for a hybrid heat system under this arrangement, by classifying, sorting and searching the respective compressors involved in the modular heat recovery units and the modular air-conditioning units in the hybrid heat system, makes it possible to find target compressors that satisfy customers' operating requirements and the purpose of energy efficiency optimization, and to achieve the effect of balancing the operating time of each compressor and improving the overall reliability of the system.

The possible modifications and specific details in the respective steps of the capacity allocation control method for a hybrid heat system will be further described below in conjunction with the accompanying drawings. In addition, additional steps may be added to further improve the energy efficiency or reliability of the system, as illustrated below.

For example, with respect to the classification step S100, the classification may include one or more of the following groups.

Wherein, the First Group is that the compressors 111*a*, 112*a*, 121*a*, 122*a*, 122*b*, 123*a*, 123*b*, 124*a*, 124*b*, 124*c* and 124*d* in all the plurality of modular heat recovery units and the plurality of modular air-conditioning units that operate normally in the air-conditioning mode are classified according to start-stop state. Specifically, it may include: Group 1-1: the compressors with a stop state in all the plurality of modular heat recovery units and the plurality of modular air-conditioning units which operate normally in the air-conditioning mode; Group 1-2: the compressors that have been stopped for over a second preset time in all the plurality of modular heat recovery units and the plurality of modular air-conditioning units which operate normally in the air-conditioning mode; Group 1-3: the compressors with a start state in all the plurality of modular heat recovery units and the plurality of modular air-conditioning units which operate normally in the air-conditioning mode; Group 1-4: the compressors that have been started for over a first preset time in all the plurality of modular heat recovery units and the plurality of modular air-conditioning units which operate normally in the air-conditioning mode; and Group 1-5: compressors other than those mentioned above.

The Second Group is that the compressors 121*a*, 122*a*, 122*b*, 123*a*, 123*b*, 124*a*, 124*b*, 124*c*, 124*d* in all the plurality of modular air-conditioning units which operate normally in the air-conditioning mode are classified according to start-stop state. Specifically, it may include: Group 2-1: the compressors with a stop state in all the plurality of modular air-conditioning units which operate normally in the air-conditioning mode; Group 2-2: the compressors that have been stopped for over a second preset time in all the plurality of modular air-conditioning units which operate normally in the air-conditioning mode; Group 2-3: the compressors with a start state in all the plurality of modular air-conditioning units which operate normally in the air-conditioning mode; Group 2-4: the compressors that have been started for over a first preset time in all the plurality of modular air-conditioning units which operate normally in the air-conditioning mode; and Group 2-5: compressors other than those mentioned above.

The Third Group is that the compressors 111*a* and 112*a* in all of the plurality of modular heat recovery units which operate normally in the air-conditioning mode are classified according to start-stop state. Specifically, it may include: Group 3-1: the compressors with a stop state in all of the plurality of modular heat recovery units which operate normally in the air-conditioning mode; Group 3-2: the compressors that have been stopped for over a second preset time in all of the plurality of modular heat recovery units which operate normally in the air-conditioning mode; Group 3-3: the compressors with a start state in all of the plurality of modular heat recovery units which operate normally in the air-conditioning mode; Group 3-4: the compressors that have been started for over a first preset time in all of the plurality of modular heat recovery units which operate normally in the air-conditioning mode; and Group 3-5: compressors other than those mentioned above.

The Fourth Group is that the compressors 111*a* and 112*a* in all of the plurality of modular heat recovery units that operate normally in the water-heating mode are classified according to start-stop state. Specifically, it may include: Group 4-1: the compressors with a stop state in all of the plurality of modular heat recovery units which operate normally in the water-heating mode; Group 4-2: the compressors that have been stopped for over a second preset time in all of the plurality of modular heat recovery units which operate normally in the water-heating mode; Group 4-3: the compressor with a start state in all of the plurality of modular heat recovery units which operate normally in the water-heating mode; Group 4-4: the compressors that have been started for over a first preset time in all of the plurality of modular heat recovery units which operate normally in the water-heating mode; and Group 4-5: compressors other than those mentioned above.

The Fifth Group is that the compressors 111*a* and 112*a* in all of the plurality of modular heat recovery units that operate normally in both the air-conditioning mode and the water-heating mode are classified according to start-stop state. Specifically, it may include: Group 5-1: the compressors with a stop state in all of the plurality of modular heat recovery units which operate normally in both the air-conditioning mode and the water-heating mode; Group 5-2: the compressors that have been stopped for over a second preset time in all of the plurality of modular heat recovery units which operate normally in both the air-conditioning mode and the water-heating mode; Group 5-3: the compressor with a start state in all of the plurality of modular heat recovery units which operate normally in both the air-conditioning mode and the water-heating mode; Group 5-4: the compressors that have been started for over a first preset time in all of the plurality of modular heat recovery units which operate normally in both the air-conditioning mode and the water-heating mode; and Group 5-5: compressors other than those mentioned above.

Regarding the groups specifically mentioned in the foregoing classification, the start of the compressor is limited with "a first preset time", or the stop of the compressor is limited with "a second preset time". The time periods are herein limited with serial numbers in order to differentiate them more clearly, so that the two are related to the start state or stop state of compressor respectively, rather than requiring that there must be a specific time length difference between the two. "First preset time" and "second preset time" can have the same time length, for example, 3-10 minutes; or they can have different time lengths, for example, 3-5 minutes for the former and 3-10 minutes for the latter.

Referring then to the Sorting Step S200, it includes: sorting the classified compressors in a stop state in ascending order according to historical operating length; and sorting the classified compressors in a start state in descending order according to historical operating time. This arrangement allows the target compressor with a shorter operating time to be started first, or the compressor with a longer operating time to be stopped first during the search process, provided that other conditions are met.

Referring then to the Search Step S300, the energy efficiency search criteria mentioned in the step may include one or more of the following: classification group, unit category, compressor capacity in the unit, compressor capacity of the first circuit in the unit, compressor capacity of the second circuit in the unit, and compressor operating mode.

Wherein, the classification group which is served as the energy efficiency search criterion refers to the groups classified in the Classification Step S100, i.e., Group 1-1, Group 1-2 . . . Group 5-4, Group 5-5, and so on.

The unit category which is served as the energy efficiency search criterion refers to specific categories of modular units, i.e., modular heat recovery unit or modular air-conditioning unit.

Compressor capacity in the unit, compressor capacity of the first circuit in the unit and compressor capacity of the second circuit in the unit, which are served as the energy efficiency search criteria, then refer to the capacity states of the circuits or all the compressors in modular units with different compressor numbers and circuit types. Wherein, if there is only a single refrigerant circuit in the system, the single refrigerant circuit can be directly defined as the first circuit. Specifically, taking the modular heat recovery units 111, 112 and the modular air-conditioning unit 121 as examples, they only have a single refrigerant circuit and a single compressor 111*a*, 112*a*, 121*a*. Therefore, when the compressor is a constant frequency compressor, the compressor capacity in the unit is 0% or 100%, and the compressor capacity of the first circuit in the unit is 0% or 100%, while it is not applicable to the search criteria of the compressor capacity of the second circuit in the unit. When the compressor is a variable frequency compressor, the compressor capacity in the unit is 0%-100%, and the compressor capacity of the first circuit in the unit is 0%-100%, while it is not applicable to the search criteria of the compressor capacity of the second circuit in the unit. Taking the modular air-conditioning unit 122 as another example, it has a single refrigerant circuit and two compressors 122*a* and 122*b*. Therefore, when the compressors are constant frequency compressors, the compressor capacity in the unit is 0%, 50% or 100%, and the compressor capacity of the first circuit in the unit is 0%, 50% or 100%, while it is not applicable to the search criteria of the compressor capacity of the second circuit in the unit. When the compressors are variable frequency compressors, the compressor capacity in the unit is 0%-100%, and the compressor capacity of the first circuit in the unit is 0%-100%, while it is not applicable to the search criteria of the compressor capacity of the second circuit in the unit. Taking the modular air-conditioning unit 123 as yet another example, it has two refrigerant circuits and each circuit is provided with a compressor 123*a*, 123*b*, respectively. Therefore, when the compressors are constant frequency compressors, the compressor capacity in the unit is 0%, 50% or 100%, the compressor capacity of the first circuit in the unit is 0% or 100%, and the compressor capacity of the second circuit in the unit is 0% or 100%. When the compressors are variable frequency compressors, the compressor capacity in the three search ranges is 0%-100%. Taking the modular air-conditioning unit 124 as still another example, it has two refrigerant circuits and each circuit is provided with two compressors 124*a*, 124*b*, and 124*c*, 124*d*, respectively. Therefore, when the compressors are constant frequency compressors, the compressor capacity in the unit is 0%, 25%, 50%, 75% or 100%, and the compressor capacity of the first circuit in the unit is 0%, 50% or 100%, and the compressor capacity of the second circuit in the unit is 0%, 50% or 100%. When the compressors are variable frequency compressors, the compressor capacity in the three search ranges is 0%-100%.

The operating mode of the compressor, as an energy efficiency search criterion, refers to cooling mode, heating mode, water-heating mode, and cooling and water-heating (i.e., total heat recovery) mode.

The detailed strategy of the Search Step S300 of the capability allocation control method in various operating modes will be continued to be described below.

For example, when a user-set instruction requires the hybrid heat system to perform either the cooling mode or the heating mode, as can be seen from the table below, the system has a capacity loading requirement at this point. The search step can be performed according to the following priorities, where the search stops after screening out the target compressor, while the search continues when the target compressor is not screened out until all priorities have been searched. If the target compressor is still missed, the search is exited and a feedback result is given.

| Compressor search criteria | | | | | | | Compressor instructions | |
|---|---|---|---|---|---|---|---|---|
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Start-stop state | Operating mode |
| 1 | Group 1-2 | — | 0% | — | — | — | Start-up | Execute cooling or heating |
| 2 | Group 1-2 | — | — | 0% | — | — | Start-up | Execute cooling or heating |

-continued

| Compressor search criteria | | | | | | | Compressor instructions | |
|---|---|---|---|---|---|---|---|---|
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Start-stop state | Operating mode |
| 3 | Group 1-2 | — | — | — | — | — | Start-up | Execute cooling or heating |

Specifically, at this point, one or more target compressors in Group 1-2 can be searched first. That is, the compressors in all of the plurality of modular heat recovery units and the plurality of modular air-conditioning units that have stopped for over a second preset time which operate normally in the air-conditioning mode are to be searched, and are to be sorted in ascending order according to historical operating time. In addition, one or more target compressors are preferentially selected wherein an overall compressor capacity of the unit, to which the one or more target compressors belong is 0%, and the relevant compressors are started after being screened out to execute the cooling or heating mode. If the target is missed at this point, one or more target compressors with the compressor capacity of the first circuit of the unit, to which the one or more target compressors belong, is 0%, are then to be selected, and the relevant compressors are started after being screened out to execute the cooling or heating mode. If the target is still missed at this point, it shall be considered that no additional restrictions are to be added to search for one or more target compressors, and the relevant compressors are started after being screened out to execute the cooling or heating mode. If the target is still missed at this point, the search step is exited and a feedback result is given.

With continued reference to the table below, if the system has a capacity unloading requirement, the search step can be performed according to the following priorities. The search stops after screening out the target compressor, and continues when the target compressor is not screened out until all the priorities have been searched. If the target is still missed after that, the search is then exited and a feedback result is given.

| Compressor search criteria | | | | | | | Compressor instructions | |
|---|---|---|---|---|---|---|---|---|
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Start-stop state | Operating mode |
| 1 | Group 1-4 | Modular air-conditioning units 122, 124 | — | 100% | — | — | Stop | Stop cooling or heating |
| 2 | Group 1-4 | Modular air-conditioning units 123, 124 | — | — | >0% | — | Stop | Stop cooling or heating |
| 3 | Group 1-4 | — | — | — | — | — | Stop | Stop cooling or heating |

Specifically, at this point, one or more target compressors in Group 1-4 can be searched first. That is, the compressors in all of the plurality of modular heat recovery units and the plurality of modular air-conditioning units that have started for over a first preset time which operate normally in the air-conditioning mode are to be searched, and to be sorted in descending order according to historical operating time. In addition, one or more target compressors are preferentially selected wherein an overall compressor capacity of the circuit of the unit 122 or 124 to which the one or more target compressors belong (e.g., first circuit) are 100%. and the relevant compressors are stopped after screening out the target to stop the cooling or heating mode. If the target is missed at this time, one or more target compressors are then to be selected wherein an overall compressor capacity of the circuit of the unit 123 or 124 to which the one or more target compressors do not belong (e.g., second circuit) are greater than 0%, and the relevant compressors are stopped after screening out the target to stop the cooling or heating mode. If the target is still missed at this point, it shall be considered that no additional restrictions are to be added to search for one or more target compressors, and the relevant compressors are stopped after screening out the target to stop the cooling or heating mode. If the target is still missed at this point, the search step is exited and a feedback result is given.

For another example, when a user-set instruction requires the hybrid heat system to perform the water-heating mode, as can be seen from the table below, the system has a capacity loading requirement at this point. The search step can be performed according to the following priorities, where the search stops after screening out the target compressor, while the search continues when the target compressor is not screened out until all the priorities have been searched. If the target is still missed, the search is exited and a feedback result is given.

| Compressor search criteria | | | | | | | Compressor instructions | |
|---|---|---|---|---|---|---|---|---|
| Priority sequence number | Classification group | Unit category | Overall compressor the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Start-stop state | Operating mode |
| 1 | Group 4-2 | — | — | — | — | — | Start-up | Execute water heating |

Specifically, at this point, one or more target compressors in Group 4-2 can be searched first. That is, the compressors in all of the plurality of modular heat recovery units that have stopped for over a second preset time which operate normally in the water-heating mode are to be searched, and to be sorted in ascending order according to historical operating time. The relevant compressors are started after screening out the target to execute the water-heating mode. If the target is still missed at this point, the search step is exited and a feedback result is given.

With continued reference to the table below, if the system has a capacity unloading requirement, the search step can be performed according to the following priorities. The search stops after screening out the target compressor, and continues when the target compressor is not screened out until all the priorities have been searched. If the target is still missed after that, the search is then exited and a feedback result is given.

| Compressor search criteria | | | | | | | Compressor instructions | |
|---|---|---|---|---|---|---|---|---|
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Start-stop state | Operating mode |
| 1 | Group 4-4 | — | — | — | — | — | Stop | Stop water heating |

Specifically, at this point, one or more target compressors in Group 4-4 can be searched first. That is, the compressors in all of the plurality of modular heat recovery units that have started for over a first preset time which operate normally in the water-heating mode are to be searched, and to be sorted in descending order according to historical operating time. The relevant compressors are stopped after screening out the target to stop the water heating mode. If the target is still missed at this point, the search step is exited and a feedback result is given.

For yet another example, when a user-set instruction requires the hybrid heat system to execute the heating and water-heating mode, as can be seen from the table below, the system has a capacity loading requirement for the air-conditioning mode at this point. The search step can be performed according to the following priorities, where the search stops after screening out the target compressor, while the search continues when the target compressor is not screened out until all the priorities have been searched, and then the search is exited and a feedback result is given.

Specifically, at this point, one or more target compressors in Group 2-2 can be searched first. That is, the compressors in all of the plurality of modular air conditioning units that have stopped for over a second preset time which operate normally in the air-conditioning mode are to be searched, and are to be sorted in ascending order according to historical operating time. In addition, one or more target compressors are preferentially selected wherein an overall compressor capacity of the unit, to which the one or more compressors belong is 0%, and the relevant compressors are started after the target is screened out to execute the heating mode. If the target is missed at this point, one or more target compressors are then to be selected wherein an overall compressor capacity of the circuit of the unit to which the one or more target compressors belong (e.g., first circuit) is 0%, and the relevant compressors are started after the target is screened out to execute the heating mode. If the target is still missed at this point, it shall be considered that no additional restrictions are to be added to search for one or more target compressors, and the relevant compressors are

| Compressor search criteria | | | | | | | | | Compressor instructions | |
|---|---|---|---|---|---|---|---|---|---|---|
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Air conditioning mode alarm | Water heating mode alarm | Start-stop state | Operating mode |
| 1 | Group 2-2 | — | 0% | — | — | — | — | — | Start-up | Execute heating |
| 2 | Group 2-2 | — | — | 0% | — | — | — | — | Start-up | Execute heating |
| 3 | Group 2-2 | — | — | — | — | — | — | — | Start-up | Execute heating |
| 4 | Group 3-2 | — | — | — | — | — | — | — | Start-up | Execute heating |
| 5 | Group 3-4 | — | — | — | — | Water heating | — | — | Start-up | Execute heating |

If the priority of air-conditioning mode is higher than that of water-heating mode, the following search criterion can be added; If no, the search may be terminated earlier started after the target is screened out to execute the heating mode. If the target is still missed at this point, it shall be considered that one or more target compressors in Group 3-2 are to be searched. That is, the compressors in all of the plurality of modular heat recovery units that have stopped for over a second preset time which operate normally in the air-conditioning mode are to be searched, and are to be sorted in ascending order according to historical operating time. The relevant compressors are started after the target is screened out to execute the heating mode. If the target is still missed at this point, and the priority of the air-conditioning mode set by the customer is higher than that of the water-heating mode, it shall then be considered that one or more target compressors in Group 3-4 are to be searched. That is, the compressors in all of the plurality of modular heat recovery units that have started for over a first preset time and are in the state of water-heating mode which operate normally in the air-conditioning mode are to be searched, and to be sorted in descending order according to historical operating time. The relevant compressors are started after the target is screened out to execute the heating mode. If the target is still missed, the search step is then exited and a feedback result is given.

With continued reference to the table below, if the system has a capacity unloading requirement for the air-conditioning mode, the search step can be performed according to the following priorities. The search stops after screening out the target compressor, and continues when the target compressor is not screened out until all the priorities have been searched. If the target is still missed after that, the search is then exited and a feedback result is given.

wherein an overall compressor capacity of the unit, to which the one or more target compressors belong, is 0%, and the relevant compressors are stopped after the target is screened out to stop the heating mode. If the target is missed at this point, one or more target compressors currently operating the heating mode are then to be selected wherein an overall compressor capacity of the unit, to which the one or more target compressors belong, is 0%. The relevant compressors are stopped after the target is screened out to stop the heating mode. If the target is still missed at this point, it shall be considered that one or more target compressors in Group 2-4 can then to be searched. That is, the compressors in all of the plurality of modular heat recovery units that have started for over a first preset time which operate normally in the air-conditioning mode are to be searched, and are to be sorted in descending order according to historical operating time. In addition, one or more target compressors currently operating the heating mode, are preferentially selected wherein an overall compressor capacity of the circuit of the unit 122 or 124 to which the one or more target compressor belongs (e.g., first circuit) is 100%, and the relevant compressors are stopped after the target is screened out to stop the heating mode. If the target is missed at this point, one or more target compressors currently operating the heating mode, are then to be selected wherein an overall compressor capacity of the circuit of the unit 123 or 124 to which the one or more target compressors do not belong (e.g., second circuit) is greater than 0%, and the relevant compressors are stopped after the target is screened out to stop the heating mode. If the target is still missed at this point, the search step is exited and a feedback result is given.

| Compressor search criteria | | | | | | | | | Compressor instructions | |
|---|---|---|---|---|---|---|---|---|---|---|
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Air conditioning mode alarm | Water heating mode alarm | Start-stop state | Operating mode |
| 1 | Group 3-4 | — | 0% | — | — | Heating | — | No | Stop | Stop heating |
| 2 | Group 3-4 | — | 0% | — | — | Heating | — | — | Stop | Stop heating |
| 3 | Group 2-4 | Modular air-conditioning units 122, 124 | — | 100% | — | Heating | — | — | Stop | Stop heating |
| 4 | Group 2-4 | Modular air-conditioning units 123, 124 | — | — | >0% | Heating | — | — | Stop | Stop heating |

Specifically, at this point, one or more target compressors in Group 3-4 can be searched first. That is, the compressors in all of the plurality of modular heat recovery units that have started for over a first preset time which operate normally in the air-conditioning mode are to be searched, and to be sorted in descending order according to historical operating time. In addition, one or more target compressors currently operating the heating mode, which operate normally in the water-heating mode, are preferentially selected With continued reference to the table below, if the system has a capacity loading requirement for the water-heating mode, the search step can be performed according to the following priorities. The search stops after screening out the target compressor, and continues when the target compressor is not screened out until all the priorities have been searched. If the target is still missed after that, the search is then exited and a feedback result is given.

| Compressor search criteria | | | | | | | | | | |
|---|---|---|---|---|---|---|---|---|---|---|
| | | | | | | | | | Compressor instructions | |
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Air conditioning mode alarm | Water heating mode alarm | Start-stop state | Running mode |
| 1 | Group 4-2 | — | — | — | — | — | yes | — | Start | Start water heating |
| 2 | Group 4-2 | — | — | — | — | — | — | — | Start | Start water heating |
| 3 | Group 4-4 | — | — | — | — | Heating | — | — | Start | Start water heating |

If the priority of water-heating mode is higher than that of air-conditioning mode, the following search criterion can be added; If no, the search may be terminated earlier Specifically, at this point, one or more target compressors in Group 4-2 can be searched first. That is, the compressors in all of the plurality of modular heat recovery units that have stopped for over a second preset time which operate normally in the water-heating mode are to be searched, and are to be sorted in ascending order according to historical operating time. In addition, one or more target compressors which operate abnormally in air-conditioning mode are preferentially selected, and the relevant compressors are started after the target is screened out to execute the water-heating mode. If the target is missed at this point, it shall be considered that no additional restrictions are to be added to search for one or more target compressors, and the relevant compressors are started after the target is screened out to execute the water-heating mode. If the target is still missed at this point, and the priority of the water-heating mode is higher than that of the air-conditioning mode, it shall be considered that one or more target compressors in Group 4-4 are to be searched. That is, the compressors in all of the plurality of modular heat recovery units that have started for over a first preset time and are in the heating mode, which operate normally in the water-heating mode are to be searched, and are to be sorted in descending order according to historical operating time. In addition, one or more target compressors currently operating the heating mode shall be preferentially selected, and the relevant compressors are started after the target is screened out to execute the water-heating mode. If the target is still missed, the search is then exited and a feedback result is given.

With continued reference to the table below, if the system has a capacity unloading requirement for the water-heating mode, the search step can be performed according to the following priorities. The search stops after screening out the target compressor, and continues when the target compressor is not screened out until all the priorities have been searched. If the target is still missed after that, the search is then exited and a feedback result is given.

| Compressor search criteria | | | | | | | | | | |
|---|---|---|---|---|---|---|---|---|---|---|
| | | | | | | | | | Compressor instructions | |
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Air conditioning mode alarm | Water heating mode alarm | Start-stop state | Operating mode |
| 1 | Group 4-4 | — | — | — | — | Water heating | No | — | Stop | Stop water heating |
| 2 | Group 4-4 | — | — | — | — | Water heating | — | — | Stop | Stop water heating |

Specifically, at this point, one or more target compressors in Group 4-4 can be searched first. That is, the compressors in all of the plurality of modular heat recovery units that have started for over a first preset time which operate normally in the water-heating mode are to be searched, and are to be sorted in descending order according to historical operating time. In addition, one or more target compressors that operate normally in the air-conditioning mode are preferentially selected, and the relevant compressors are stopped after the target is screened out to stop the water-heating mode. If the target is missed at this point, it shall be considered that no additional restrictions are to be added to search for one or more target compressors, and the relevant compressors are stopped after the target is screened out to stop the water-heating mode. If the target is still missed, the search is then exited and a feedback result is given.

For still another example, when a user-set instruction requires the hybrid heat system to execute the cooling and water-heating mode, as can be seen from the table below, the system has a capacity loading requirement for both the air-conditioning mode and the water-heating mode at this point. The search step can be performed according to the following priorities, where the search stops after the target compressor is screened out, while the search continues when the target compressor is not screened out until all the priorities have been searched. If the target is still missed after that, the search is then exited and a feedback result is given.

Specifically, at this point, one or more target compressors in Group 5-2 can be searched first. That is, the compressors that have stopped for over a second preset time in all of the plurality of modular heat recovery units which operate normally in both the air-conditioning mode and the water-heating mode are to be searched, and are to be sorted in ascending order according to historical operating time. After screening out the target, the relevant compressors are started to execute the cooling and water-heating mode. If the target is still missed at this point, the two capacity loading requirements respectively for the air-conditioning mode and the water-heating mode can be handled separately, that is, the loading requirement for the air-conditioning mode and the loading requirement for the water-heating mode can be searched separately.

With continued reference to the table below, if the system has capacity unloading requirements for both the air-conditioning mode and the water-heating mode at the same time, the search step can be performed according to the following priorities. The search stops after the target compressor is screened out, and continues when the target compressor is not screened out until all the priorities have been searched. If the target is still missed after that, the search is then exited and a feedback result is given.

| | Compressor search criteria | | | | | | | | | |
|---|---|---|---|---|---|---|---|---|---|---|
| | | | | | | | | | Compressor instructions | |
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Air conditioning mode alarm | Water heating mode alarm | Start-stop state | Running mode |
| 1 | Group 5-2 | — | — | — | — | — | — | — | Start | Start cooling + water heating |

| Compressor search criteria | | | | | | | | | Compressor instructions | |
|---|---|---|---|---|---|---|---|---|---|---|
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Air conditioning mode alarm | Water heating mode alarm | Start-stop state | Running mode |
| 1 | Group 5-4 | — | — | — | — | Cooling + water heating | — | — | Stop | Stop cooling + water heating |

Specifically, at this point, one or more target compressors in Group 5-4 can be searched first. That is, the compressors that have started for over a first preset time in all of the plurality of modular heat recovery units which operate normally in both the air-conditioning mode and the water-heating mode are searched, and are sorted in descending order according to historical operating time. After screening out the target, the relevant compressors are stopped to stop the cooling and water-heating mode. If the target is still missed at this point, the two capacity unloading requirements respectively for the air-conditioning mode and the water-heating mode can be handled separately, that is, the unloading requirement for the air-conditioning mode and the unloading requirement for the water-heating mode can be searched separately.

With continued reference to the table below, if the system has a capacity unloading requirement for the air-conditioning mode, the search step can be performed according to the following priorities. The search stops after the target compressor is screened out, and continues when the target compressor is not screened out until all the priorities have been searched. If the target is still missed after that, the search is then exited and a feedback result is given.

| Compressor search criteria | | | | | | | | | Compressor instructions | |
|---|---|---|---|---|---|---|---|---|---|---|
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Air conditioning mode alarm | Water heating mode alarm | Start-stop state | Operating mode |
| 1 | Group 3-4 | — | — | — | — | Cooling | — | No | Stop | Stop cooling |
| 2 | Group 3-4 | — | — | — | — | Cooling | — | — | Stop | Stop cooling |
| 3 | Group 2-4 | Modular air conditioning units 122, 124 | — | 100% | — | Cooling | — | — | Stop | Stop cooling |
| 4 | Group 2-4 | Modular air conditioning units 123, 124 | — | — | >0% | Cooling | — | — | Stop | Stop cooling |
| 5 | Group 2-4 | — | — | — | — | Cooling | — | — | Stop | Stop cooling |

-continued

| Compressor search criteria | | | | | | | | | Compressor instructions | |
|---|---|---|---|---|---|---|---|---|---|---|
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Air conditioning mode alarm | Water heating mode alarm | Start-stop state | Operating mode |
| 6 | Group 3-4 | — | — | — | — | Cooling + water heating | — | — | Stop | Stop cooling + water heating |
| | Group 5-2 | — | — | — | — | — | — | — | Start | Start water heating |
| 7 | Group 3-4 | — | — | — | — | Cooling + water heating | — | — | Start | Start water heating |

Specifically, at this point, one or more target compressors in Group 3-4 can be searched first. That is, the compressors that have started for over a first preset time in all of the plurality of modular heat recovery units which operate normally in the air-conditioning mode are searched, in which the compressors that are in the cooling mode and are sorted in descending order according to historical operating time are further searched. In addition, one or more target compressors which operate normally in the water-heating mode are preferentially selected. After screening out the target, the relevant compressors are stopped to stop the cooling mode. If the target is missed at this point, it shall be considered that no additional restrictions are to be added to search for one or more target compressors, and the relevant compressors are stopped after the target is screened out to stop executing the cooling mode.

If the target is still missed at this point, it shall be considered that one or more target compressors in Group 2-4 are to be searched. That is, the compressors that have started for over a first preset time in all of the plurality of modular heat recovery units which operate normally in the air-conditioning mode are to be searched, and are to be sorted in descending order according to historical operating time. In addition, one or more target compressors currently operating in the cooling mode are preferentially selected wherein an overall compressor capacity of the circuit of the unit 122 or 124 to which the one or more target compressors belong (e.g., first circuit) is 100%. After screening out the target, the relevant compressors are stopped to stop executing the cooling mode. If the target is missed at this point, one or more target compressors currently operating in the cooling mode are then to be selected wherein an overall compressor capacity of the circuit 123 or 124 to which the one or more target compressors do not belong is greater than 0%. After screening out the target, the relevant compressors are stopped to stop executing the cooling mode. If the target is missed at this point, one or more target compressors currently operating the cooling mode are further selected. After screening out the target, the relevant compressors are stopped to stop executing the cooling mode.

If the target is still missed at this point, it then shall be considered to return to search for one or more target compressors in Group 3-4. That is, the compressors that have started for over a first preset time in all of the plurality of modular heat recovery units which operate normally in the air-conditioning mode are to be searched in which the compressors that are in the cooling and water-heating mode and are sorted in descending order according to historical operating time are further searched. In addition, the scheme of stopping the cooling and water-heating mode of the target compressors in Group 3-4 and starting the water-heating mode of the target compressors in Group 5-2 are preferentially to be selected. If the target is missed at this point, the secondary selection is to directly switch the operating mode of the target compressors in Group 3-4 to the water-heating mode. If the target is still missed at this point, the search step is exited and the feedback result is given.

With continued reference to the table below, if the system has a capacity unloading requirement for the water-heating mode, the search step can be performed according to the following priorities. The search stops after the target compressor is screened out, and continues when the target compressor is not screened out until all the priorities have been searched. If the target is still missed after that, the search is then exited and a feedback result is given.

| Compressor search criteria | | | | | | | | | Compressor instructions | |
|---|---|---|---|---|---|---|---|---|---|---|
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Air conditioning mode alarm | Water heating mode alarm | Start-stop state | Operating mode |
| 1 | Group 4-4 | — | — | — | — | Water heating | No | — | Stop | Stop water heating |
| 2 | Group 4-4 | — | — | — | — | Water heating | — | — | Stop | Stop water heating |
| 3 | Group 4-4 | — | — | — | — | Cooling + Water heating | — | — | Stop | Stop cooling + water heating |
| | Group 2-2 | — | 0% | — | — | — | — | — | Start | Start cooling |
| 4 | Group 4-4 | — | — | — | — | Cooling + water heating | — | — | Stop | Stop cooling + water heating |
| | Group 2-2 | — | — | 0% | — | — | — | — | Start | Start cooling |
| 5 | Group 4-4 | — | — | — | — | Cooling + water heating | — | — | Stop | Stop cooling + water heating |
| | Group 2-2 | — | — | — | — | — | — | — | Start | Start cooling |
| 6 | Group 4-4 | — | — | — | — | Cooling + water heating | — | — | Stop | Stop cooling + water heating |
| | Group 5-2 - | — | — | — | — | — | — | — | Start | Start cooling |
| 7 | Group 4-4 | — | — | — | — | Cooling + water heating | — | — | Start | Start cooling |

Specifically, at this point, one or more target compressors in Group 4-4 can be searched first. That is, the compressors that have started for over a first preset time in all of the plurality of modular heat recovery units which operate normally in the water-heating mode are to be searched, in which the compressors that are in the water-heating mode and are sorted in descending order according to historical operating time are further searched. In addition, one or more target compressors are preferentially selected wherein the compressors in the unit to which the one or more target compressors belong operate normally in the air-conditioning mode. After screening out the target, the relevant compressors are stopped to stop the water-heating mode. If the target is missed at this point, it shall be considered that no additional restrictions are to be added to search for one or more target compressors, and the relevant compressors are stopped after the target is screened out to stop executing the water-heating mode.

If the target is still missed at this point, it shall be considered continuing the search for one or more target compressors in Group 4-4. That is, the compressors that have started for over a first preset time in all of the plurality of modular heat recovery units which operate normally in the water-heating mode are to be searched, in which the compressors that are in the cooling and water-heating mode and are sorted in descending order according to historical operating time are further searched. In addition, the scheme of stopping the cooling and water-heating mode of the target compressors in Group 4-4 and starting the cooling mode of the target compressors in Group 2-2 whose unit's overall compressor capacity is 0% are preferentially to be selected. If the target is missed at this point, the cooling and water-heating mode of the target compressors in Group 4-4 are to be stopped, and the cooling mode of the target compressors in Group 2-2 are to be started wherein an overall compressor capacity of the circuit of the unit to which the target compressors belong (i.e., the first circuit) is 0%. If the target is missed at this point, the cooling and water-heating mode of the target compressors in Group 4-4 are to be stopped, and the cooling mode of the target compressors in Group 2-2 are to be started by considering not adding additional restrictions. If the target is missed at this point, the cooling and water-heating mode of the target compressors in Group 4-4 are to be stopped, and the scheme of starting the cooling mode of the target compressors in Group 5-2 are to be considered without adding additional restrictions. If the target is missed at this point, the scheme of directly switching the cooling and water-heating mode of the target compressors in Group 4-4 to the cooling mode can be considered. If the target is still missed at this point, the search step is exited and the feedback result is given.

With continued reference to the table below, if the system has a capacity loading requirement for the air-conditioning mode, the search step can be performed according to the following priorities. The search stops after the target compressor is screened out, and continues when the target compressor is not screened out until all the priorities have been searched. If the target is still missed after that, the search is then exited and a feedback result is given.

selected. If the target is missed at this point, then consider the scheme of stopping the water-heating mode of the target compressors in Group 4-3 and starting the cooling and water-heating mode of the target compressors in Group 5-1. If the target is still missed at this point, then consider the scheme of directly switching the target compressors in Group 4-4 that is operating the water-heating mode which operate normally in air-conditioning mode to the cooling and water-heating mode. If the target is missed at this point, consider the scheme of directly switching the water-heating mode of the target compressors in Group 4-3 which is

| Compressor search criteria | | | | | | | | | Compressor instruction | |
|---|---|---|---|---|---|---|---|---|---|---|
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Air conditioning mode alarm | Water heating mode alarm | Start-stop state | Operating mode |
| 1 | Group 4-4 | — | — | — | — | Water heating | — | — | Stop | Stop water heating |
| | Group 5-1 | — | — | — | — | — | — | — | Start | Start cooling + water heating |
| 2 | Group 4-3 | — | — | — | — | Water heating | — | — | Stop | Stop water heating |
| | Group 5-1 | — | — | — | — | — | — | — | Start | Start cooling + water heating |
| 3 | Group 4-4 | — | — | — | — | Water heating | No | — | Start | Start cooling + water heating |
| 4 | Group 4-3 | — | — | — | — | Water heating | No | — | Start | Start cooling + water heating |
| 5 | Group 2-2 | — | 0% | — | — | — | — | — | Start | Start cooling |
| 6 | Group 2-2 | — | — | 0% | — | — | — | — | Start | Start cooling |
| 7 | Group 2-2 | — | — | — | — | — | — | — | Start | Start cooling |
| 8 | Group 3-2 | — | — | — | — | — | — | Yes | Start | Start cooling |
| 9 | Group 3-2 | — | — | — | — | — | — | — | Start | Start cooling |

Specifically, at this point, one or more target compressors in Group 4-4 can be searched first. That is, the compressors that have started for over a first preset time in all of the plurality of modular heat recovery units which operate normally in the water-heating mode are searched in which the compressors that are in the water-heating mode and are sorted in descending order according to historical operating time are further searched. In addition, the scheme of stopping the water-heating mode of the target compressors in Group 4-4 and starting the cooling and water-heating mode of the target compressors in Group 5-1 is preferentially operating in the water-heating mode and operating normally in air-conditioning mode to the cooling and water-heating mode.

If the target is still missed at this point, it shall be considered continuing the search for one or more target compressors in Group 2-2. That is, the compressors that have stopped for over a second preset time in all of the plurality of modular air conditioning units which operate normally in the air-conditioning mode are to be searched, and are to be sorted in ascending order according to historical operating time. Wherein, one or more target compressors are to be preferentially selected wherein an overall compressor capacity of the unit, to which the one or more target compressors belong is 0%. After screening out the target, the relevant compressors are started to execute the cooling mode. If the target is missed at this point, one or more target compressors are to be selected wherein an overall compressor capacity of the circuit of the unit to which the one or more target compressors belong (e.g., the first circuit) is 0%. After screening out the target, the relevant compressors are started to execute the cooling mode. If the target is missed at this point, it shall be considered that no additional restrictions are to be added to search for one or more target compressors, and the relevant compressors are started after the target is screened out to execute the cooling mode.

If the target is still missed at this point, it shall be considered continuing the search for one or more target compressors in Group 3-2. That is, the compressors that have stopped for over a second preset time in all of the plurality of modular heat recovery units which operate normally in the air-conditioning mode are to be searched, and are to be sorted in ascending order according to historical operating time. Wherein, one or more target compressors whose unit's compressors are operating abnormally in the water heating mode are to be preferentially selected. After screening out the target, the relevant compressors are started to execute the cooling mode. If the target is missed at this point, it shall be considered that no additional restrictions are to be added to search for one or more target compressors, and the relevant compressors are started after the target is screened out to execute the cooling mode. If the target is still missed at this point, the search step is exited and the feedback result is given.

With continued reference to the table below, if the system has a capacity loading requirement for the water-heating mode, the search step can be performed according to the following priorities. The search stops after the target compressor is screened out, and continues when the target compressor is not screened out until all the priorities have been searched. If the target is still missed after that, the search is then exited and a feedback result is given.

| Compressor search criteria | | | | | | | | | Compressor instructions | |
|---|---|---|---|---|---|---|---|---|---|---|
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Air conditioning mode alarm | Water heating mode alarm | Start-stop state | Running mode |
| 1 | Group 3-4 | — | — | — | — | Cooling | — | — | Stop | Stop cooling |
| | Group 5-1 | — | — | — | — | — | — | — | Start | Start cooling + water heating |
| 2 | Group 3-3 | — | — | — | — | Cooling | — | — | Stop | Stop cooling |
| | Group 5-1 | — | — | — | — | — | — | — | Start | Start cooling + water heating |
| 3 | Group 3-4 | — | — | — | — | Cooling | — | No | Start | Start cooling + water heating |
| 4 | Group 3-3 | — | — | — | — | Cooling | — | No | Start | Start cooling + water heating |
| 5 | Group 4-2 | — | — | — | — | — | Yes | — | Start | Start water heating |
| 6 | Group 4-2 | — | — | — | — | — | — | — | Start | Start water heating |

Specifically, at this point, one or more target compressors in Group 3-4 can be searched first. That is, the compressors that have started for over a first preset time in all of the plurality of modular heat recovery units which operate normally in the air-conditioning mode are searched in which compressors that are in the cooling mode and are sorted in descending order according to historical operating time are further searched. In addition, the scheme of stopping the cooling mode of the target compressors in Group 3-4 and starting the cooling and water-heating mode of the target compressors in Group 5-1 is preferentially selected. If the target is missed at this point, then consider the scheme of stopping the cooling mode of the target compressors in Group 3-3 and starting the cooling and water-heating mode of the target compressors in Group 5-1. If the target is still missed at this point, then consider the scheme of directly switching the cooling mode of the target compressors in Group 3-4 which are operating in the cooling mode and operate normally in water-heating mode to the cooling and water-heating mode. If the target is missed at this point, consider the scheme of directly switching the cooling mode of the target compressors in Group 3-3 which is operating in the cooling mode and operate normally in water-heating mode to the cooling and water-heating mode.

If the target is still missed at this point, it shall be considered continuing the search for one or more target compressors in Group 4-2. That is, the compressors that have stopped for over a second preset time in all of the plurality of modular heat recover units which operate normally in the water-heating mode are to be searched, and are to be sorted in ascending order according to historical operating time. Wherein, one or more target compressors which operate abnormally in the air-conditioning mode shall be preferentially selected, and relevant compressors shall be started after screening out the target to execute the water-heating mode. If the target is missed at this point, it shall be considered that no additional restrictions are to be added to search for one or more target compressors, and the relevant compressors are started after the target is screened out to execute the water-heating mode. If the target is still missed at this point, the search step is exited and the feedback result is given.

On this basis, as a further energy efficiency optimization and modification for the capacity allocation control method, a consolidation step S400 can be additionally provided to consolidate the compressors operating in the cooling mode and the compressors operating in the water-heating mode into the compressors operating in the cooling and water-heating mode. This step helps to reduce the number of compressors operating at the same time while maintaining the stability of the existing operating mode and output capacity.

Specifically, with reference to the table below, when the system has the operating requirements for the air-conditioning mode and the water-heating mode at the same time, the consolidation step can be performed according to the following priorities. The search stops after the target compressor is screened out and the consolidation can be started, whereas the search continues when the target compressor is not screened out until all the priorities have been searched. If the target is still missed after that, the search is then exited and a feedback result is given.

| Compressor search criteria | | | | | | | | | | |
|---|---|---|---|---|---|---|---|---|---|---|
| | | | | | | | | | Compressor instructions | |
| Priority sequence number | Classification group | Unit category | Overall compressor capacity of the unit to which the compressor belongs | Overall compressor capacity of the circuit of the unit to which the compressor belongs (e.g., first circuit) | Overall compressor capacity of the circuit of the unit to which the compressor does not belong (e.g., second circuit) | Compressor operating mode | Air conditioning mode alarm | Water heating mode alarm | Start-stop state | Operating mode |
| 1 | Group 1-3 | — | — | — | — | Cooling | — | — | Stop | Stop cooling |
| | Group 4-3 | | | | | Water heating | | | Stop | Stop water heating |
| | Group 5-2 | — | — | — | — | — | — | — | Start | Start cooling + water heating |
| 2 | Group 1-3 | — | — | — | — | Cooling | — | — | Stop | Stop cooling |
| | Group 4-3 | — | — | — | — | Water heating | — | — | Stop | Stop water heating |
| | Group 3-3 | — | — | — | — | Water heating | No | — | Start | Start cooling + water heating |
| 3 | Group 1-3 | — | — | — | — | Cooling | — | — | Stop | Stop cooling |
| | Group 4-3 | — | — | — | — | Water heating | — | — | Stop | Stop water heating |
| | Group 4-3 | — | — | — | — | Cooling | — | No | Start | Start cooling + water heating |

Specifically, at this point, one or more target compressors in Group 1-3 can be searched first. That is, the compressors with a start state in all the plurality of modular heat recovery units and the plurality of modular air-conditioning units which operate normally in the air-conditioning mode can be searched in which compressors that are in the cooling mode and are sorted in descending order according to the historical operating time are further searched. At the same time, one or more target compressors in Group 4-3 are searched. That is, the compressors with a start state in all the plurality of modular heat recovery units which operate normally in the water-heating mode are to be searched in which the compressors that are in the water-heating mode and are sorted in descending order according to the historical operating time are further searched. In addition, it is preferred to consolidate the two into one or more target compressors in the operation Group 5-2, which are sorted in ascending order according to historical operating time, and make them execute the cooling and water-heating mode. If the target is missed at this point, it shall consider consolidating the two into operating one or more target compressors in the Group 3-3 that are operating in the water-heating mode and operate normally in the air-conditioning mode, and are sorted in descending order according to historical operating time, and make them execute the cooling and water-heating mode. If the target is still missed at this point, it shall consider consolidating the two into operating one or more target compressors in the Group 4-3 that are operating in the cooling mode and operates normally in the water-heating mode, and are sorted in descending order according to historical operating time, and make them execute the cooling and water-heating mode. If the target is still missed at this point, the search step is exited and the feedback result is given.

In addition, although not shown in the figures, a readable storage medium is also provided here, on which application programs are stored, wherein the application programs are executed by the processor to realize the capability allocation control method as described above, thus achieving the corresponding technical effects.

As for the processor referred to in the control system, it can be any type of processor, including but are not limited to: microprocessor (μP), microcontroller (μC), digital signal processor (DSP) or any combination thereof. The processor may include one or more levels of cache, such as the Level 1 cache and Level 2 cache, and may also include a processor core and registers. As an example, the processor core may include an arithmetic logic unit (ALU), a floating point unit (FPU), a digital signal processing core (DSP core), or any combination thereof. In some embodiments, the memory controller can be used with the processor, or in other embodiments, the memory controller can be a built-in part of the processor.

As for the readable storage medium referred to in the control system, it can be any type of memory, including but not limited to: volatile memory (such as RAM), non-volatile memory (such as ROM, flash memory, etc.), EEPROM, CD-ROM or other optical disk storage (including compact disk, laser disk, optical disk, digital universal optical disk, Blu-ray optical disk, etc.), disk storage media or other magnetic storage devices, or can be any other medium that can be used to carry or store the desired program code in the form of instructions or data structures and can be accessed by electronic devices, or any combination thereof. The system storage may include an operating system, one or more applications, and program data. In some embodiments, the application may be arranged to operate on the operating system using program data.

The above examples mainly illustrate the hybrid heat system, capability allocation control method thereof, readable storage medium and control system according to the present invention. Although only some of the embodiments of the present invention are described, those skilled in the art should understand that the present invention can, without departing from the spirit and scope of the present invention, be implemented in many other forms. Therefore, the illustrated examples and embodiments are to be considered as illustrative but not restrictive, and the present invention may cover various modifications or replacements if not departed from the spirit and scope of the present invention as defined by the appended claims.

What is claimed is:

1. A capacity allocation control method for a hybrid heat system, wherein the hybrid heat system comprises a plurality of modular heat recovery units with an air-conditioning mode and a water-heating mode, and a plurality of modular air-conditioning units with an air-conditioning mode, the control method comprising:

a classification step S100 for classifying compressors in the plurality of modular heat recovery units and the plurality of modular air-conditioning units according to unit category, unit state and start-stop state;

a sorting step S200 for sorting classified compressors according to operating time; and a search step S300 for searching target compressors from sorted compressors based on preset energy efficiency search criteria;

controlling one or more of the compressors in response to the classification step S100, the sorting step S200 and the search step S300.

2. The capacity allocation control method according to claim 1, wherein classification in the classification step S100 comprises one or more groups in the following categories:

First Group: classifying compressors in all the plurality of modular heat recovery units and the plurality of modular air-conditioning units which operate normally in the air-conditioning mode according to start-stop state;

Second Group: classifying compressors in all the plurality of modular air-conditioning units which operate normally in the air-conditioning mode according to start-stop state;

Third Group: classifying compressors in all the plurality of modular heat recovery units which operate normally in the air-conditioning mode according to start-stop state;

Fourth Group: classifying compressors in all the plurality of modular heat recovery units which operate normally in the water-heating mode according to start-stop state;

Fifth Group: classifying compressors in all the plurality of modular heat recovery units which operate normally in both the air-conditioning mode and the water-heating mode according to start-stop state.

3. The capacity allocation control method according to claim 2, wherein the start-stop state comprises: compressor start, compressor started for over a first preset time, compressor stop and compressor stop for over a second preset time.

4. The capacity allocation control method according to claim 3, wherein the sorting step S200 further comprises:

sorting classified compressors in a stop state in ascending order according to historical operating time; and sorting classified compressors in a start state in descending order according to historical operating time.

5. The capacity allocation control method according to claim 4, wherein the energy efficiency search criteria in the search step S300 comprise one or more of the following: classification group, unit category, compressor capacity in a unit, compressor capacity of a first circuit in a unit, compressor capacity of a second circuit in a unit, and compressor operating mode.

6. The capacity allocation control method according to claim 5, wherein when the hybrid heat system is operating in a cooling or heating mode:

in response to the system having a capacity loading requirement, one or more of the target compressors in the First Group that have stopped for over a second preset time and are sorted in ascending order according to historical operating time are searched; or in response to the system having a capacity unloading requirement, one or more of the target compressors in the First Group that have started for over a first preset time and are sorted in descending order according to historical operating time are searched.

7. The capacity allocation control method according to claim 6, wherein:

in response to the system having a capacity loading requirement, one or more of the target compressors are searched according to priorities of compressor capacity in the unit being 0%; compressor capacity of the first circuit in the unit being 0%; and without additional restrictions; or in response to the system having a capacity unloading requirement, one or more of the target compressors are searched according to the priorities of compressor capacity of the first circuit in the unit being 100%; compressor capacity of the second circuit in the unit being greater than 0%; and without additional restrictions.

8. The capacity allocation control method according to claim 5, wherein when the hybrid heat system is operating in the water-heating mode:

in response to the system having a capacity loading requirement, one or more of the target compressors in the Fourth Group that have stopped for over a second preset time and are sorted in ascending order according to historical operating time are searched; or in response to the system having a capacity unloading requirement, one or more of the target compressors in the Fourth Group that have started for over a first preset time and are sorted in descending order according to historical operating time are searched.

9. The capacity allocation control method according to claim 5, wherein when the hybrid heat system is operating in the heating and the water-heating mode:

in response to the air-conditioning mode of the system having a capacity loading requirement, search is performed in turn according to the following priorities: one or more of the target compressors in the Second Group that have stopped for over a second preset time and are sorted in ascending order according to historical operating time; one or more of the target compressors in the Third Group that have stopped for over a second preset time and are sorted in ascending order according to historical operating time; and one or more of the target compressors in the Third Group that have started for over a first preset time and are in the water-heating mode and sorted in descending order according to historical operating time; or in response to the air-conditioning mode of the system having a capacity unloading requirement, search is performed in turn according to the following priorities: one or more of the target compressors in the Third Group that have started for over a first preset time and are sorted in descending order according to historical operating time; and one or more of the target compressors in the Second Group that have started for over a first preset time and are sorted in descending order according to historical operating time; or in response to the water-heating mode of the system having a capacity loading requirement, search is performed in turn according to the following priorities: one or more of the target compressors in the Fourth Group that have stopped for over a second preset time and are sorted in ascending order according to historical operating time; and one or more of the target compressors in the Fourth Group that have started for over a first preset time and are in the heating mode and sorted in descending order according to historical operating time; or in response to the water-heating mode of the system having a capacity unloading requirement, one or more of the target compressors in the Fourth Group that have started for over a first preset time and are in the water-heating mode and sorted in descending order according to historical operating time are searched.

10. The capacity allocation control method according to claim 9, wherein:

if in response to the air-conditioning mode of the system having a capacity loading requirement, for the one or more of the target compressors in the Second Group, one or more of the target compressors are searched according to the priorities of compressor capacity in the unit being 0%; compressor capacity of the first circuit in the unit being 0%; and without additional restrictions.

11. The capacity allocation control method according to claim 9, wherein:

in response to the air-conditioning mode of the system having a capacity unloading requirement, for one or more of the target compressors in the Third Group, one or more of the target compressors are searched according to the priorities of the compressor capacity in the unit being 0% and operating normally in the water-heating mode; and the compressor capacity in the unit being 0% and without additional restrictions; or in response to the air-conditioning mode of the system having a capacity unloading requirement, for one or more of the target compressors in the Second Group, one or more of the target compressors are searched according to the priorities of the compressor capacity of the first circuit in the unit being 100%, and the compressor capacity of the second circuit in the unit being greater than 0%.

12. The capacity allocation control method according to claim 9, wherein:

in response to the water-heating mode of the system having a capacity loading requirement, for one or more of the target compressors in the Fourth Group, one or more of the target compressors are searched according to the priorities of the compressor in the unit operates abnormally in the air-conditioning mode and without additional restrictions.

13. The capacity allocation control method according to claim 9, wherein:

in response to the water-heating mode of the system having a capacity unloading requirement, for one or more of the target compressors in the Fourth Group, one or more of the target compressors are searched according to the priorities of the compressor in the unit operates normally in the air-conditioning mode; and without additional restrictions.

14. The capacity allocation control method according to claim 5, wherein when the hybrid heat system operates in the cooling and water heating mode:

in response to both the air-conditioning mode and the water-heating mode of the system having a capacity loading requirement, one or more of the target compressors in the Fifth Group that have stopped for over a second preset time and are sorted in ascending order according to historical operating time are searched; or in response to both the air-conditioning mode and the water-heating mode of the system having a capacity unloading requirement, one or more of the target compressors in the Fifth Group that have started for over a first preset time, and are in the cooling and water heating mode and sorted in descending order according to historical operating time are searched; or in response to the air-conditioning mode of the system having a capacity unloading requirement, search is performed in turn according to the following priorities: one or more of the target compressors in the Third Group that have started for over a first preset time and are in the cooling mode and sorted in descending order according to historical operating time; one or more of the target compressors in the Second Group that have started for over a first preset time and are in the cooling mode and sorted in descending order according to historical operating time; and one or more of the target compressors in the Third Group that have started for over a first preset time and are in the cooling and water-heating mode and sorted in descending order according to historical operating time; or in response to the water-heating mode of the system having a capacity unloading requirement, search is performed in turn according to the following priorities: one or more of the target compressors in the Fourth Group that have started for over a first preset time and are in the water-heating mode and sorted in descending order according to historical operating time; and one or more of the target compressors in the Fourth Group that have started for over a first preset time and are in the cooling and water heating mode and sorted in descending order according to historical operating time; or in response to the air-conditioning mode of the system having a capacity loading requirement, search is performed in turn according to the following priorities: one or more of the target compressors in the Fourth Group that have started for over a first preset time and are in the water-heating mode and sorted in descending order according to historical operating time; one or more of the target compressors in the Fourth Group that are started and are in the water-heating mode and sorted in descending order according to historical operating time; one or more of the target compressors in the Second Group that have stopped for over a second preset time and are sorted in ascending order according to historical operating time; and one or more of the target compressors in the Third Group that have stopped for over a second preset time and are sorted in ascending order according to historical operating time; or in response to the water-heating mode of the system having a capacity loading requirement, search is performed in turn according to the following priorities: one or more of the target compressors in the Third Group that have started for over a first preset time and are in the cooling mode and sorted in descending order according to historical operating time; one or more of the target compressors in the Fourth Group that are started and are in the cooling mode and sorted in descending order according to historical operating time; and one or more of the target compressors in the Fourth group that have stopped for over a second preset time and are sorted in ascending order according to historical operating time.

15. The capacity allocation control method according to claim 14, wherein:

in response to the air-conditioning mode of the system having a capacity unloading requirement, for one or more of the target compressors in the Third Group, one or more of the target compressors are searched according to the priorities of the compressor in the unit operates normally in the water-heating mode; and without additional restrictions; or in response to the air-conditioning mode of the system having a capacity unloading requirement, for one or more of the target compressors in the Second Group, one or more of the target compressors are searched according to the priorities of the compressor capacity of the first circuit in the unit being 100%; the compressor capacity of the second circuit in the unit being greater than 0%; and without additional restrictions; or in response to the air-conditioning mode of the system having a capacity unloading requirement, for one or more of the target compressors in the Third Group, one or more of the target compressors are searched according to the priorities of stopping the compressors in the Third Group and starting the compressors in the Fifth Group; and switching the compressors in the Third Group to the empty water-heating mode.

16. The capacity allocation control method according to claim 14, wherein:

in response to the water-heating mode of the system having a capacity unloading requirement, for one or more of the target compressors in the Fourth Group, one or more of the target compressors are searched according to the priorities of the compressor in the unit operates normally in the air-conditioning mode; and without additional restrictions; or in response to the water-heating mode of the system having a capacity unloading requirement, for one or more of the target compressors in the Fourth Group, one or more of the target compressors are searched according to the priorities of stopping the compressor in the Fourth Group and starting the compressor in the Second Group with a compressor capacity being 0%; stopping the compressor in the Fourth Group and starting the compressor in the Second Group with a compressor capacity of the first circuit being 0%; stopping the compressor in the Fourth Group and starting the compressor in the Second Group; stopping the compressor in the Fourth Group and starting the compressor in the Fifth Group; and switching the compressor in the Fourth Group to the cooling mode.

17. The capacity allocation control method according to claim 14, wherein:

in response to the air-conditioning mode of the system having a capacity loading requirement, for one or more of the target compressors in the Fourth Group, one or more of the target compressors are searched according to the priorities of stopping the compressor in the Fourth Group that has started for over a first preset time and starting the stopped compressor in the Fifth Group; stopping the compressor in the Fourth Group and starting the stopped compressor in the Fifth Group; switching the compressor in the Fourth Group that has started for over a first preset time and operates normally in the air-conditioning mode to the cooling and water-heating mode; and one or more of the target compressors are searched according to the priority of switching the compressor in the Fourth Group that operates normally in the air-conditioning mode to the cooling and water-heating mode; or in response to the air-conditioning mode of the system having a capacity loading requirement, for one or more of the target compressors in the Second Group, one or more of the target compressors are searched according to the priorities of the compressor capacity in the unit being 0%; the compressor capacity of the first circuit in the unit being 0%; and without additional restrictions; or in response to the air-conditioning mode of the system having a capacity loading requirement, for one or more of the target compressors in the Third Group, one or more of the target compressors are searched according to the priorities of the compressor in the unit operates abnormally in the water-heating mode; and without additional restrictions.

18. The capacity allocation control method according to claim 14, wherein:

in response to the water-heating mode of the system having a capacity loading requirement, for one or more of the target compressors in the Third Group, one or more of the target compressors are searched according to the priorities of stopping the compressor in the Third Group that has started for over a first preset time and starting the stopped compressor in the Fifth Group; stopping the compressor in the Third Group and starting the stopped compressor in the Fifth Group; switching the compressor in the Third Group that has started for over a first preset time and operates normally in the water-heating mode to the cooling and water heating mode; and switching the compressor in the Third Group that has started and operates normally in the water-heating mode to the cooling and water heating mode; or in response to the water-heating mode of the system having a capacity loading requirement, for one or more of the target compressors in the Fourth Group, one or more of the target compressors are searched according to the priorities of the compressor in the unit operates abnormally in the air-conditioning mode; and without additional restrictions.

19. The capacity allocation control method according to claim 5, further comprising: a consolidation step S400 for consolidating a compressor in cooling mode and a compressor in water-heating mode into a compressor operating in the cooling and water-heating mode.

20. The capacity allocation control method according to claim 19, wherein: consolidation priorities of the consolidation step S400 comprise:

consolidating one or more of the target compressors in the First Group that have been started, are in the cooling mode and sorted in descending order according to historical operating time, and one or more of the target compressors in the Fourth Group that have been started, are in the water-heating mode and sorted in descending order according to historical operating time into operating one or more of the target compressors in the Fifth Group that have stopped and are sorted in ascending order according to historical operating time;

consolidating one or more of the target compressors in the First Group that have been started, are in the cooling mode and sorted in descending order according to historical operating time, and one or more of the target compressors in the Fourth Group that have been started, are in the water-heating mode and sorted in descending order according to historical operating time into operating one or more of the target compressors in the Third Group that have started, and operate normally in the air-conditioning mode and sorted in descending order according to historical operating time; and consolidating one or more of the target compressors in the First Group that have been started, are in the cooling mode and sorted in descending order according to historical operating time, and one or more of the target compressors in the Fourth Group that have been started, are in the water-heating mode and sorted in descending order according to historical operating time into operating one or more of the target compressors in the Fourth Group that have started, and operate normally in the water-heating mode and sorted in descending order according to historical operating time.

21. A non-transitory readable storage medium, wherein the readable storage medium is used for storing the capacity allocation control method for a hybrid heat system according to claim 1.

22. A control system, comprising:

the non-transitory readable storage medium according to claim 21; and a processor configured to perform the capacity allocation control method stored on the non-transitory readable storage medium.

23. A hybrid heat system, comprising:

a plurality of modular heat recovery units capable of operating air-conditioning mode and water-heating mode respectively;

a plurality of modular air-conditioning units capable of operating air-conditioning mode; and a controller configured to perform the capacity allocation control method for a hybrid heat system according to claim 1.

* * * * *